US010494825B2

(12) United States Patent
Wang

(10) Patent No.: US 10,494,825 B2
(45) Date of Patent: Dec. 3, 2019

(54) JOINT COMPOUND CONTAINER

(71) Applicant: Ping Kun Wang, Kaohsiung (TW)

(72) Inventor: Ping Kun Wang, Kaohsiung (TW)

( * ) Notice: Subject to any disclaimer, the term of this patent is extended or adjusted under 35 U.S.C. 154(b) by 0 days.

(21) Appl. No.: 15/869,353

(22) Filed: Jan. 12, 2018

(65) Prior Publication Data

US 2019/0218803 A1 Jul. 18, 2019

(51) Int. Cl.

| | |
|---|---|
| ***B65D 6/32*** | (2006.01) |
| ***B65D 8/22*** | (2006.01) |
| ***E04G 21/16*** | (2006.01) |
| ***E04F 21/00*** | (2006.01) |
| *B65D 6/04* | (2006.01) |

(52) U.S. Cl.

CPC ..... *E04G 21/16* (2013.01); *E04F 21/00* (2013.01)

(58) Field of Classification Search

CPC ..... E04G 21/16; E04F 21/00
USPC ..... 220/617, 678, 612
See application file for complete search history.

(56) References Cited

U.S. PATENT DOCUMENTS 2,370,304 A * 2/1945 Grant ..... F25D 23/062 219/137 R
3,458,224 A * 7/1969 Freese ..... B23K 33/004 219/137 R
4,561,476 A * 12/1985 Bunkoczy ..... B65D 88/04 141/311 R
4,567,014 A * 1/1986 Popp ..... G21F 5/12 376/272
4,596,688 A * 6/1986 Popp ..... G21F 5/12 220/612
4,624,379 A * 11/1986 Rothenbucher ..... F28F 9/02 220/4.01
4,790,472 A * 12/1988 Bunkoczy ..... B65D 88/04 220/566
4,858,652 A * 8/1989 Bobichon ..... G01N 23/02 138/92
5,777,343 A * 7/1998 Rasel ..... G21F 5/002 220/679
2003/0178432 A1* 9/2003 Meiland ..... B65D 83/38 220/612
2006/0169705 A1* 8/2006 Pool ..... E04G 21/005 220/629
2006/0273086 A1* 12/2006 Marino ..... B65D 5/22 220/62.1
2008/0000918 A1* 1/2008 Bruno ..... E04G 21/005 220/695
2016/0185524 A1* 6/2016 Goad ..... B29C 66/7234 220/565

* cited by examiner

*Primary Examiner* — J. Gregory Pickett
*Assistant Examiner* — Niki M Eloshway
(74) *Attorney, Agent, or Firm* — Rosenberg, Klein & Lee

(57) ABSTRACT

A joint compound container includes a plurality of metal plates connected with each other to form a trench-shaped body having an opening facing upwardly. The trench-shaped body has an outer surface and an inner surface. Melted layer are formed on edges of connecting portions of each of the metal plates. A thickness of each of the melted layers is reduced from the outer surface toward the inner surface, and the melted layers are not exceeding out of the inner surface. The metal plates are connected with each other through the melted layers. Hence, the joint compound received in the container can be scraped out from the container smoothly along the inner surface of the container. Hence, the trench-shaped body of the joint compound container can have great sealing property, and the efficiency in performing the tasks can be greatly improved.

4 Claims, 5 Drawing Sheets

JOINT COMPOUND CONTAINER

BACKGROUND OF THE INVENTION

Field of the Invention

The present invention relates to a container structure, in particular to a joint compound container having a smooth inner surface without slags formed on the inner surface.

Description of the Prior Art

Joint compound containers are applied to fill cements, glues, or other engineering joint compounds. According to practical requirements, mixing tasks can be achieved with the containers. In operation, a user holds the container with one hand and holds a scraper with the other hand. Then, the user uses the scraper to scrap out the joint compound in the container along the inner wall of the container. Therefore, a proper amount of joint compound may be attached on the scraper for coating on wallboards.

In conventional, the joint compound containers are usually made of metals for durability, and several metal plates are connected to form a trench-shaped body having an opening facing upwardly via high-temperature welding techniques. In the welding process, welding rods are melting to form welding fluxes to connect the metal plates with each other. Moreover, as shown in FIG. 5, for improving the structural strength and the sealing of the welded product, protruding welding beads 52 are formed at the connecting portions between the metal plates 51. Moreover, when the welding fluxes are not solidified, the welding fluxes are penetrated into the interior of the joint compound container from gaps between the metal plates 51 to form protruding welding beads 521 on the inner surface 53 of the joint compound container. Moreover, when the joint compound container is manufactured by using welding techniques with welding rods, the welding sludge are spread on the container during the welding process, and irregular welding slags 54 are formed on the inner surface 53 of the joint compound container. As a result, the appearance of the container is greatly influenced by these slags.

Furthermore, the protruding welding beams 521 and the slags 54 on the inner surface 53 of the conventional joint compound container make the inner surface 53 of the container uneven. Consequently, because the inner surface of the container is uneven, the user cannot use the scraper to scrap out the joint compound in the container along the inner wall of the container in a proper and smooth manner when the user operates the conventional container. Moreover, because of the uneven inner surface of the container, the amount of the joint compound cannot be controlled precisely, thereby reducing the efficiency in performing the tasks.

SUMMARY OF THE INVENTION

One object of the present invention is to provide a joint compound container having great sealing property, and the joint compound received in the container can be scraped out from the container smoothly along the inner surface of the container. Hence, the efficiency in performing the tasks can be greatly improved.

In view of these, a joint compound container is provided. In one embodiment, the joint compound container comprises a plurality of metal plates connected with each other to form a trench-shaped body having an opening facing upwardly. The trench-shaped body has an outer surface and an inner surface. Melted layer are formed on edges of connecting portions of each of the metal plates. A thickness of each of the melted layers is reduced from the outer surface toward the inner surface, and the melted layers are not exceeding out of the inner surface. The metal plates are connected with each other through the melted layers.

In one embodiment, the thickness of each of the melted layers is reduced from the outer surface toward the inner surface and the melted layers are flush with the inner surface.

In one embodiment, the metal plates comprise a bottom plate with a U-shaped cross section and two side plates, and two ends of the bottom plate respectively have open ends, and the two side plates respectively shield the open ends. Moreover, the bottom plate has a bottom portion being flat and two end walls extending upwardly, and two curved portions are connected between the bottom portion and the two end walls, respectively.

DETAIL DESCRIPTION OF THE PREFERRED EMBODIMENTS

Figure 1:
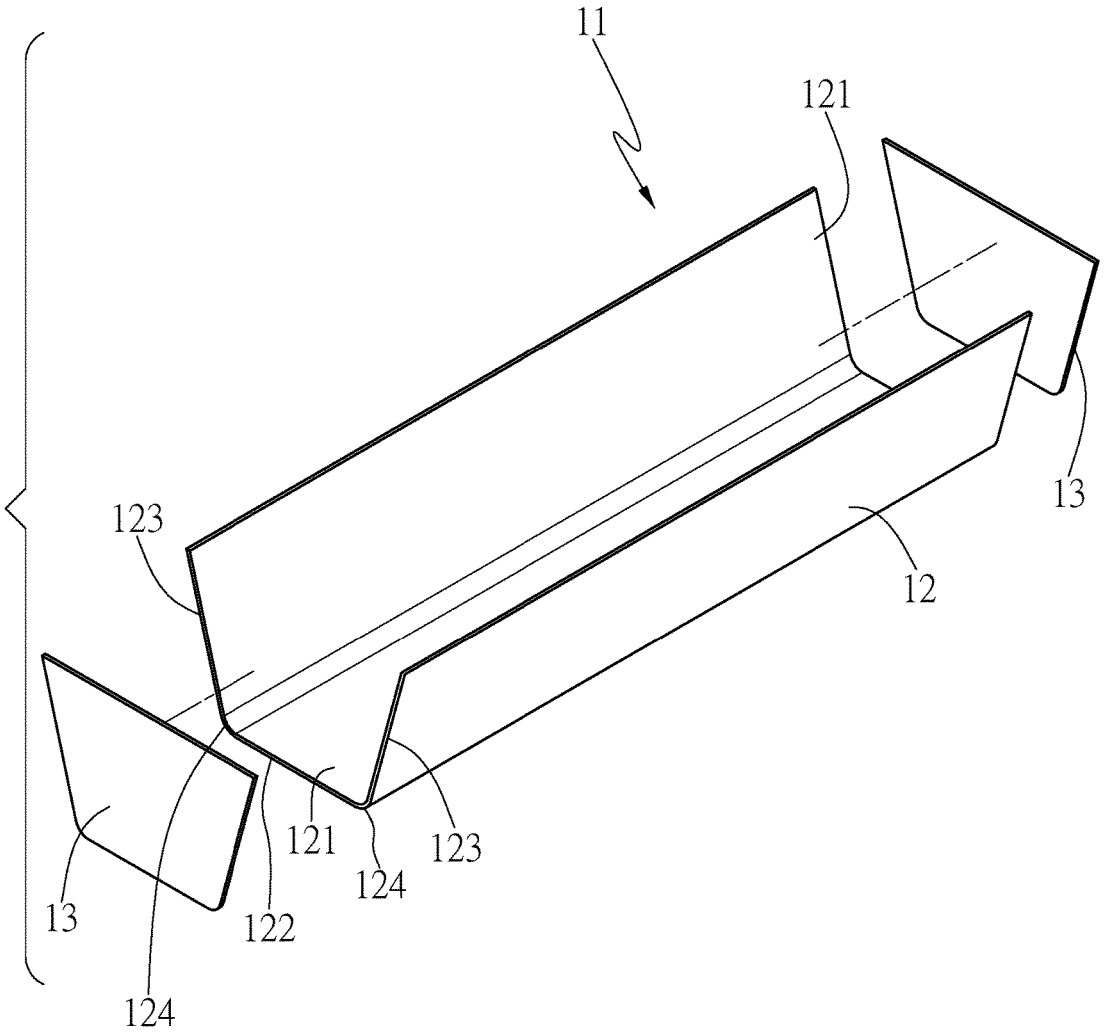
FIG. 1 illustrates an exploded view of the trench-shaped body of the joint compound container according to an embodiment of the present invention.
Figure 2:
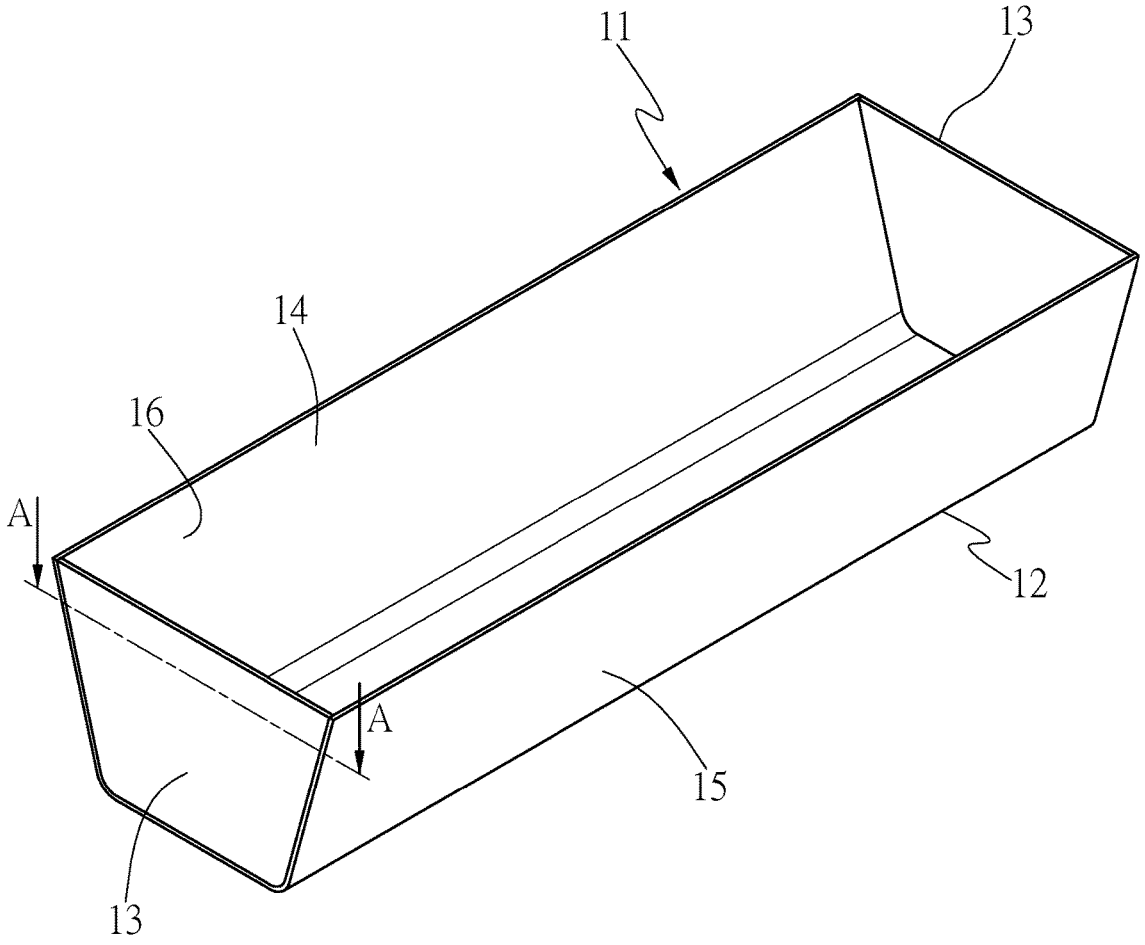
FIG. 2 illustrates an assembled view of the trench-shaped body of the joint compound container.
Figure 3:
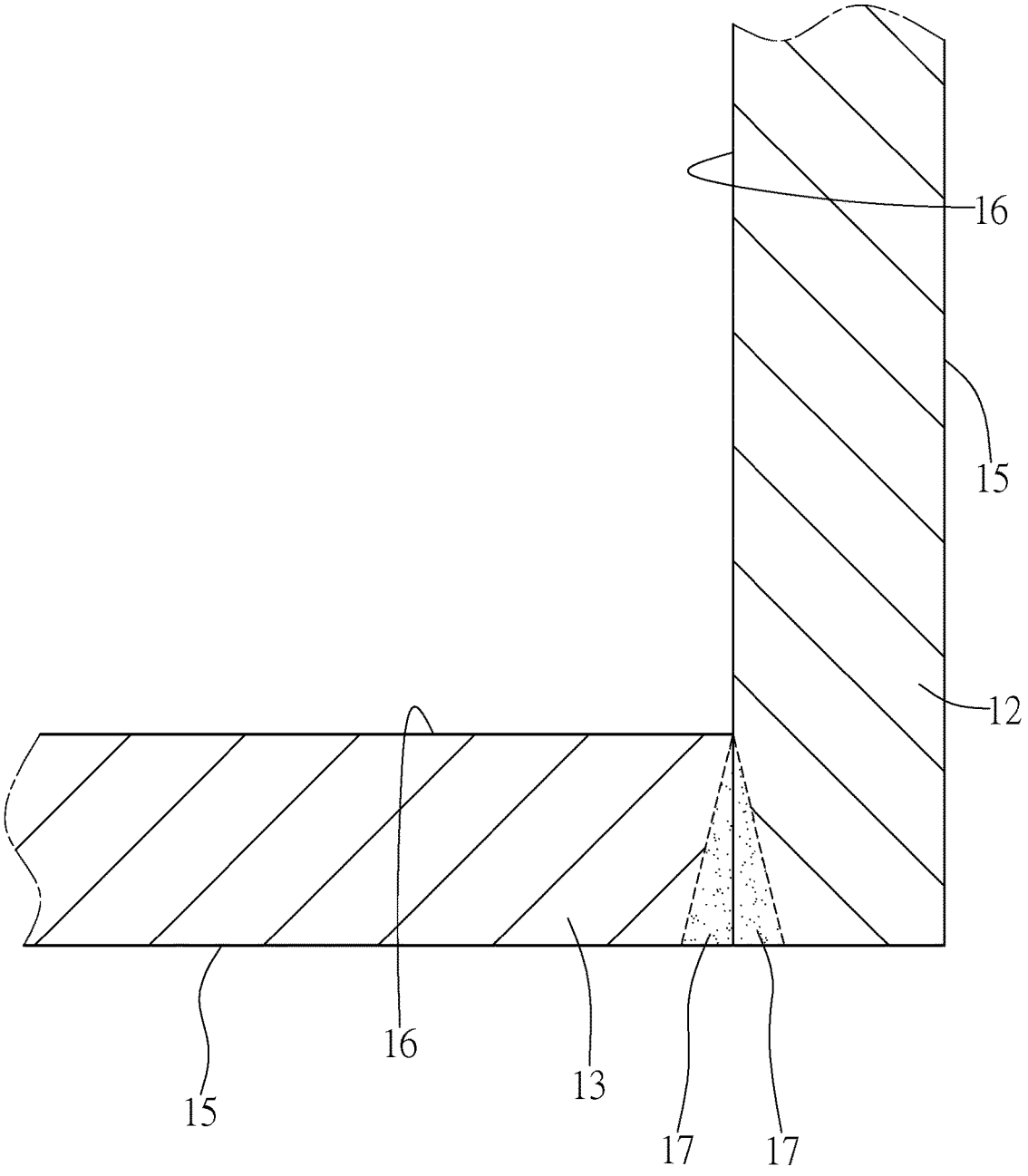
FIG. 3 illustrates a cross sectional view along line A-A shown in FIG. 2.

Please refer to FIGS. 1 to 3, illustrating a joint compound container according to an embodiment of the present invention. In this embodiment, the joint compound container comprises several metal plates connected with each other to form a trench-shaped body 11 having an opening facing upwardly, and the metal plates are made of identical materials (e.g., stainless steel). In this embodiment, the metal plates comprise a bottom plate 12 with a U-shaped cross section and two side plates 13. The bottom plate 12 is formed by bending an elongate plate. Two ends of the bottom plate 12 respectively have open ends 121. The bottom plate 12 has a bottom portion 122 being plate and two ends walls 123 extending upwardly and inclinedly. Two curved portions 124 are connected between the bottom portion 122 and the two end walls 123, respectively. The two side plates 13 respectively assembled on the edges of the two end walls 123 to shield the open ends 121, and then a high temperature melting method without using welding rods is applied to melt the bottom plate 11 and the two side plates 13 to form the trench-shaped body 11 having the opening 14 facing upwardly.

The trench-shaped body 11 has an outer surface 15 and an inner surface 16, and edges of the connected portions of the bottom plate 12 and the side plates 13 are heated to the melting point, so that the edges of the connected portions of the bottom plate 12 and the side plates 13 are melted to form melted layers 17, respectively. A thickness of each of the melted layers 17 is reduced from the outer surface 15 toward the inner surface 16 and the melted layers 17 are not exceeding out of the inner surface 16. The bottom plate 12 and the side plates 13 are firmly connected with each other through the melted layers 17. In this embodiment, as shown in FIG. 3, the thickness of each of the melted layers 17 is reduced from the outer surface 15 toward the inner surface 16, and the melted layers 17 are flush with the inner surface 16. Since the melted layer 17 of the bottom plate 12 and the melted layers 17 of the side plates 13 are not exceeding out of the inner surface 16, the inner surface 16 of the trench-shaped body 11 is glossy and smooth.

Figure 4:
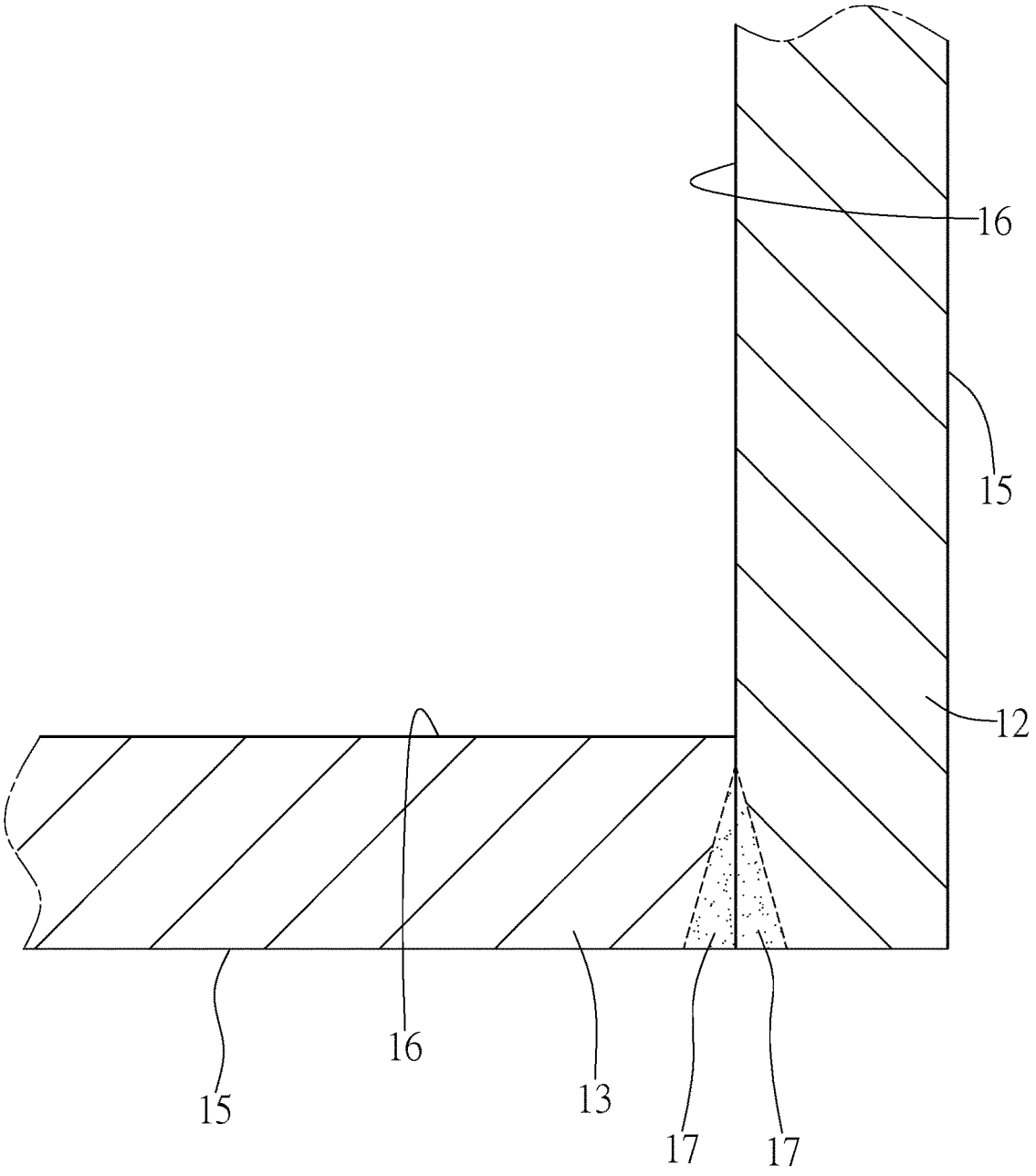
FIG. 4 illustrates a sectional view of one embodiment of the trench-shaped body.
Figure 5:
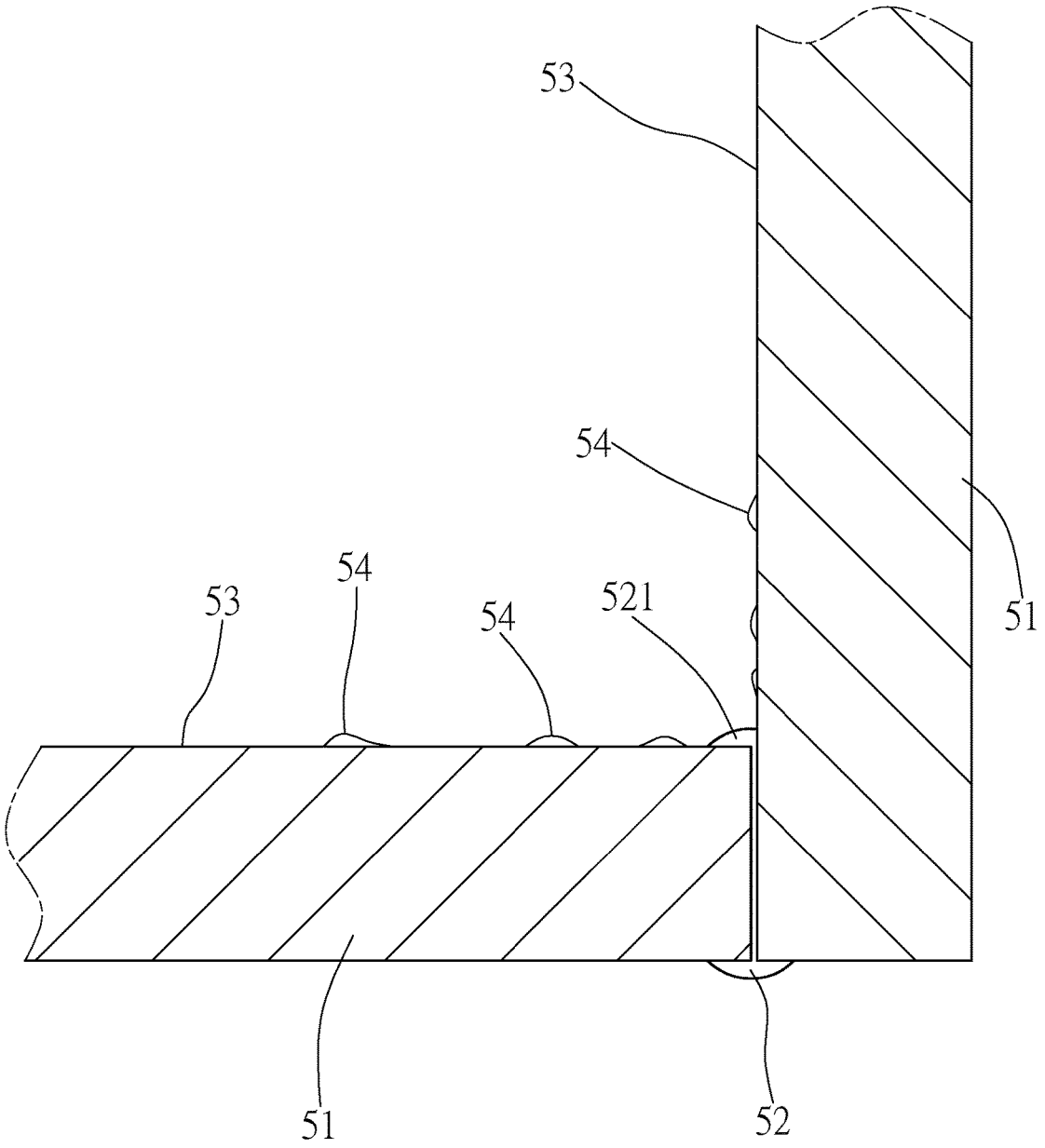
FIG. 5 PRIOR ART
FIG. 5 illustrates a cross sectional view of a conventional joint compound container.

Further, as shown in FIG. 4, in one embodiment, the thickness of each of the melted layers 17 is reduced from the outer surface 15 toward the inner surface 16 and the melted layers 17 are aligned to be not flush with the inner surface 16. Hence, the trench-shaped body 11 with a glossy and smooth inner surface 16 can be also achieved.

According to the joint compound container, the bottom plate 12 and the side plates 13 are connected with each other through the melted layers 17 formed on the edges of the connected portions of the bottom plate 12 and the side plates 13, and the bottom plate 12 and the two side plates 13 are made of metal plates with same materials. Therefore, when the bottom plate 12 and the side plates 13 are connected with each other through the melted layers 17, the strength and the sealing of the product can be ensured. Hence, the joint compound container can provide a proper sealing performance. Furthermore, since the thickness of each of the melted layers 17 is reduced from the outer surface 15 toward the inner surface 16 and the melted layers 17 are not exceeding out of the inner surface 16, protruding welding beams and slags are not formed on the inner surface 16 of the trench-shaped body 11, the inner surface 16 of the trench-shaped body 11 is glossy and smooth, and the appearance of the joint compound container is beautiful.

Moreover, since the thickness of each of the melted layers 17 is reduced from the outer surface 15 toward the inner surface 16 and the melted layers 17 are not exceeding out of the inner surface 16, the inner surface 16 of the joint compound container is glossy and smooth. Hence, the user can use a scraper to scrap out the joint compound in the container along the inner wall 16 of the container efficiently, and the amount of the joint compound can be controlled in a proper manner. Therefore, the time for operation can be reduced to improve the efficiency in performing the tasks. Furthermore, since the inner surface 16 of the trench-shaped body 11 is glossy and smooth, the cleaning of the trench-shaped body 11 can be performed easily without leaving the joint compound in the container.

What is claimed is:

1. A joint compound container comprising a plurality of metal plates (12, 13, 13) defining at least two side plates (13, 13) and a bottom plate (12) where each of said two side plates (13, 13) are respectively joined to opposing ends of said bottom plate (12) to form a trench-shaped body (11) having an upward-facing opening, the trench-shaped body having an outer surface (15) and an inner surface (16), each of the metal plates (12, 13, 13) having connecting portions thereof formed with melted regions (17) of each of said side plates (13, 13) and said bottom plate (12), the melted regions (17) forming a triangular contour in cross section having an apex at an intersection of an inner surface of each of said side plates (13, 13) and an inner surface of said bottom plate (12) at respective opposing ends of said bottom plate (12), said melted regions (17) forming a linearly directed base being substantially coplanar with respect to an outer surface of each of said side plates (13, 13) and said bottom plate (12), a thickness of each of the melted regions (17) being reduced from the outer surface of said side plates (13, 13) and outer surface of said bottom plate (12) to the inner surface of said side plates (13, 13) and inner surface of said bottom plate (12) and being flush and terminating at said apex of said triangular contour cross section of said melted regions (17) at said intersection of an inner surface of each of said side plates (13, 13) and an inner surface of said bottom plate (12) at respective opposing ends of said bottom plate (12), each of said side plates (13, 13) and said bottom plate (12) forming a substantially continuous and planar connection of said melted regions (17) with respect to said bottom plate (12) and each of said side plates (13, 13).

2. The joint compound container according to claim 1, wherein the metal plates include said bottom plate with a U-shaped cross section and said two side plates, two ends of the bottom plate respectively have open ends, and the two side plates respectively shield the open ends.

3. The joint compound container according to claim 2, wherein the bottom plate has a flat bottom portion and two end walls extending upwardly, two curved portions are connected between the bottom portion and the two end walls, respectively.

4. The joint compound container according to claim 1, wherein the melted regions extend continuously along edges of the connecting portions of the metal plates.

* * * * *